US007258535B2

(12) United States Patent
Takagi

(10) Patent No.: US 7,258,535 B2
(45) Date of Patent: Aug. 21, 2007

(54) SEALING FEATURES FOR A PUMP AND INK JET PRINTER MOUNTING THE PUMP

(75) Inventor: Osamu Takagi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 123 days.

(21) Appl. No.: 11/086,911

(22) Filed: Mar. 23, 2005

(65) Prior Publication Data

US 2005/0214155 A1 Sep. 29, 2005

(30) Foreign Application Priority Data

Mar. 23, 2004 (JP) ..... 2004-085204

(51) Int. Cl.
*F04C 2/00* (2006.01)

(52) U.S. Cl. ..... 418/255; 418/254

(58) Field of Classification Search ..... 418/145, 418/146, 147, 112, 125, 136, 139, 142, 113, 418/219, 255, 254, 178, 82
See application file for complete search history.

(56) References Cited

U.S. PATENT DOCUMENTS

| | | | | |
|---|---|---|---|---|
| 601,158 | A * | 3/1898 | Murphy | 418/145 |
| 944,708 | A * | 12/1909 | Vollmann | 418/98 |
| 953,430 | A * | 3/1910 | Moukos | 418/219 |
| 1,066,506 | A * | 7/1913 | Krogel | 418/129 |
| 1,377,210 | A * | 5/1921 | Lindsay | 418/23 |
| 1,649,256 | A * | 11/1927 | Roessler | 418/147 |
| 1,743,977 | A * | 1/1930 | Petersen | 418/219 |
| 1,839,485 | A * | 1/1932 | King | 418/255 |
| 2,013,916 | A * | 9/1935 | Jackson | 123/243 |

(Continued)

FOREIGN PATENT DOCUMENTS

DE 40 16 015 A1 12/1990

(Continued)

OTHER PUBLICATIONS

Principles of New Machinery, 1997, Tenth Edition, p. 203 (27.13 Cary's rotary pump, part 1) "Kikai no so Fukkan Iinkai Hensha, Rikogakusha".

*Primary Examiner*—Thomas Denion
*Assistant Examiner*—Mary A Davis
(74) *Attorney, Agent, or Firm*—Oliff & Berridge, PLC

(57) ABSTRACT

A pump is provided with a housing, a rotor, and a separating member. The housing is formed by connecting two housing members. A first housing member has a cylindrical wall and a bottom wall, and the other end of the cylindrical wall is open. A second housing member comprises a sealing portion, a side portion and a connecting portion. The side portion extends from the sealing portion to the bottom side of the first housing member along an outer face of the cylindrical wall of the first housing member. The connecting portion connects a distal end of the side portion to the first housing member. The sealing portion fits tightly with the cylindrical wall of the first housing member along its entire circumference. The open end of the first housing member is reliably sealed by the second housing member. The shape of the cavity within the housing is adjusted reliably to a predetermined shape. Fluid can reliably be prevented from leaking between spaces divided by the rotor and the separating member within the housing and pump efficiency improves.

10 Claims, 9 Drawing Sheets

U.S. PATENT DOCUMENTS

| | | | | | |
|---|---|---|---|---|---|
| 2,202,911 | A | * | 6/1940 | Johnson | 418/219 |
| 2,220,095 | A | * | 11/1940 | Grey | 418/219 |
| 2,593,457 | A | * | 4/1952 | Jastrzebski | 60/437 |
| 4,380,770 | A | * | 4/1983 | Maruyama | 347/29 |
| 4,605,361 | A | * | 8/1986 | Cordray | 418/38 |
| 4,792,292 | A | | 12/1988 | Gaenzel | |
| 4,898,524 | A | * | 2/1990 | Butzen | 418/136 |
| 6,071,106 | A | * | 6/2000 | Martensen et al. | 418/140 |
| 6,193,354 | B1 | * | 2/2001 | Ito | 347/30 |
| 6,561,637 | B2 | * | 5/2003 | Hino | 347/92 |
| 2005/0214155 | A1 | | 9/2005 | Takagi | |

FOREIGN PATENT DOCUMENTS

| | | | |
|---|---|---|---|
| DE | 42 20 659 | A1 | 1/1993 |
| EP | 333391 | A2 * | 9/1989 |
| JP | 2004-268272 | | 9/2004 |
| JP | 2004-270455 | | 9/2004 |
| WO | WO 2005/001246 | A1 | 1/2005 |

* cited by examiner (a)

(b)

(a)

(b)

PRIOR ART

SEALING FEATURES FOR A PUMP AND INK JET PRINTER MOUNTING THE PUMP

CROSS-REFERENCE TO RELATED APPLICATION

This application claims priority to Japanese Patent Application No. 2004-085204, filed on Mar. 23, 2004, the contents of which are hereby incorporated by reference into the present application.

BACKGROUND OF THE INVENTION

1. Field of the Invention

The present invention relates to a pump provided with a housing and a rotor that rotates within the housing, the pump drawing fluid into the housing and forcing the drawn fluid to the exterior of the housing. The present invention also relates to an ink jet printer mounting this pump.

2. Description of the Related Art

Rotary pumps are known to the art. One example of a rotary pump is set forth in Principles of New Machinery, 1997, Tenth Edition, p. 203 (27.13 Cary's rotary pump, part 1) "Kikai no so Fukkan Iinkai Hensha, Rikogakusha". This pump is termed a Cary's rotary pump.

As shown in FIG. 9, a Cary's rotary pump 70 is provided with a housing 73, a rotor 74, a pair of blades (separating members) 76*a* and 76*b* and a compressed spring 75. An inlet port 71 and an outlet port 72 are formed in the housing 73. The rotor 74 is cylindrical, and has a groove 78 therein extending across its diameter. The rotor 74 rotates while making contact with a portion of an inner face of the housing 73 between the inlet port 71 and the outlet port 72. The pair of blades (the separating members) 76*a* and 76*b* are housed in the groove 78. The compressed spring 75 is housed between the pair of blades (the separating members) 76*a* and 76*b*. The compressed spring 75 presses the pair of blades (the separating members) 76*a* and 76*b* against the inner face of the housing 73.

When the rotor 74 rotates, the pair of blades 76*a* and 76*b* rotates integrally with the rotor 74 while making contact with the inner face of the housing 73. Centrifugal force operating on the pair of blades 76*a* and 76*b* increases the force pressing the pair of blades 76*a* and 76*b* against the inner face of the housing 73.

The pair of blades 76*a* and 76*b* and the rotor 74 separate a cavity within the housing 73 into three divided spaces. That is, the cavity within the housing 73 is separated into: a divided space 77*a* linked with the inlet port 71, a divided space 77*b* linked with neither the inlet port 71 nor the outlet port 72, and a divided space 77*c* linked with the outlet port 72.

When the pair of blades 76*a* and 76*b* are rotating integrally with the rotor 74, this rotation occurring in a clockwise direction, and while the pair of blades 76*a* and 76*b* are making contact with the inner face of the housing 73, the volume of the divided space 77*a* linked with the inlet port 71 increases, and the volume of the divided space 77*c* linked with the outlet port 72 decreases. The increase in volume of the divided space 77*a* linked with the inlet port 71 draws fluid such as water, air, or the like, into the housing 73 from the inlet port 71. The decrease in volume of the divided space 77*c* linked with the outlet port 72 elevates the pressure of the fluid drawn into the housing 73, and this pressurized fluid is discharged to the exterior of the housing 73 from the outlet port 72.

SUMMARY OF THE INVENTION

In the above type of rotary pump, pump efficiency falls if fluid leaks between the divided spaces 77*a*, 77*b*, and 77*c* formed within the housing 73. 'Pump efficiency' refers to the quantity of liquid actually delivered compared to the quantity of liquid that could theoretically be delivered. If pump efficiency is low, the pump must be rotated at high speed to obtain a desired flow quantity, and problems occur with vibration, noise, and durability. Since energy efficiency is also worse, a large motor is necessary, thus creating problems with the size of the device or with production costs. Moreover, low-efficiency pumps have the characteristic that pump performance can change greatly when changes occur in the resistance in a passage of fluid or when fluid properties change. That is, pump performance is unstable. A pump is required that is highly efficient and is stable in performance. For this purpose, a configuration is required in which the divided spaces within the housing are separated reliably so that fluid will not leak between these divided spaces.

The cavity within the housing is separated by the housing, the rotor and the separating member. A configuration is required in which it is difficult for fluid to leak between the housing and the rotor, or between the housing and the separating member.

For this reason, the housing must have a high accuracy of shape and a high degree of rigidity. Furthermore, the precision of the positional relationship between the housing and the rotor must be controlled constantly.

In order to manufacture components cheaply, it is advantageous to perform molding by using a mold die. However, components molded in this manner do not generally have a high accuracy of shape. Molding components that do have a high accuracy of shape, however, increases manufacturing costs.

With present techniques, it is not possible to obtain a pump that is highly efficient and has a stable performance while working with the accuracy of shape achieved when components are produced cheaply and in quantity by means of a mold die. Accuracy of shape of molded components varies widely, and this has been known to result in liquid leaking between the divided spaces within the housing.

An object of the present invention is to present a pump configuration in which each of the components has the accuracy of shape obtained when the components are produced cheaply and in quantity by means of a mold die, and yet in which simultaneously high pump efficiency can be obtained. A pump configuration is presented in which the components have an accuracy of shape that is not particularly high and is obtained when the components are produced cheaply and in quantity by means of molding, and yet in which fluid cannot easily leak between the housing and the rotor, or between the housing and the separating member.

Another object of the present invention is to present a pump configuration in which each of the components has the accuracy of shape obtained when the components are produced cheaply and in quantity by means of a mold die, and yet in which fluid can be prevented from leaking to the exterior of the housing. A pump configuration is presented in which the components have an accuracy of shape that is not particularly high and is obtained when the components are produced cheaply and in quantity by means of the mold die, and yet in which fluid cannot easily leak to the exterior of the housing.

Yet another object of the present invention is to present an ink jet printer in which printing performance does not readily change even when the properties of ink used for printing change.

A pump of the present invention comprises a housing, a rotor, and a separating member. The housing is formed by connecting two housing members. A first housing member is cylindrical. The first housing member has a cylindrical wall and a bottom wall formed at one axial end of the cylindrical wall, and the other end of the cylindrical wall is open. A second housing member comprises a cover for sealing the open end of the first housing member. The first housing member is provided with an inlet port and an outlet port that are formed in the cylindrical wall.

The rotor is installed within the cylindrical wall of the first housing member. The separating member rotates with the rotor while making contact with an inner face of the first housing member. The second housing member comprises a sealing portion, a side portion and a connecting portion. The sealing portion fits tightly with the open end of the cylindrical wall of the first housing member and thus seals cavity within the cylindrical wall from the atmosphere. The side portion extends from the sealing portion to the bottom side of the first housing member along an outer face of the cylindrical wall of the first housing member. The connecting portion connects a distal end of the side portion to the first housing member. The connecting portion of the second housing member is connected to the first housing member by means of a fixing means. The side portion covers at least partially a side face of the first housing member.

When the rotor and the separating member rotate within the housing, fluid is drawn into the housing from the inlet port formed in the housing. Pressure of the fluid is increased within the divided space enclosed by the housing, the rotor and the separating member, and the pressurized fluid is forced to the exterior of the housing.

The first housing member, being cylindrical in shape with a base, is open at the end where the base is not formed. The second housing member covers this open end.

The second housing member comprises a sealing portion, a side portion and a connecting portion. The sealing portion fits tightly with the open end of the cylindrical wall of the first housing member. The side portion extends from the sealing portion to the other end of the first housing member and covers at least partially a side face of the first housing member. The connecting portion is formed at a distal end of the side portion (the end opposite the sealing portion), and the second housing member is connected to the first housing member at the location of the connecting portion. The connecting portion is nearer to the base of the first housing member than the sealing portion. Consequently, connecting the second housing member to the first housing member at this location results in uniform pressure being exerted between the sealing portion of the second housing member and the first housing member. The sealing portion thus fits tightly with the cylindrical wall of the first housing member along its entire circumference. The open end of the first housing member is reliably sealed by the second housing member. Consequently, fluid can be prevented from leaking to the exterior of the housing that has been formed by fitting together the first housing member and the second housing member, and pump efficiency improves.

It is preferred that the first housing member is longer in the axial direction than the side portion of the second housing member. That is, it is preferred that, when the second housing member is connected to the first housing member at the connecting portion, a relationship is attained in which a compressing force is exerted on the cylindrical wall of the first housing member, and a pulling force is exerted on the side portion of the second housing member.

With this relationship, the sealing portion is pushed onto the end of the cylindrical wall of the first housing member and fits tightly therewith. Consequently, fluid can reliably be prevented from leaking to the exterior of the housing. Fluid can reliably be prevented from leaking between the divided spaces within the housing, and pump efficiency improves.

It is preferred that a ring-shaped concave groove is formed in the sealing portion of the second housing member. The open end of the cylindrical wall of the first housing member is received into this concave groove. It is preferred that a fitting face is formed at an inner face of the concave groove. An inner face of the cylindrical wall of the first housing member fits tightly with this fitting face.

In this case, the inner face of the cylindrical wall of the first housing member fits tightly with the fitting face of the concave groove formed in the sealing portion of the second housing member. Consequently, fluid can be prevented from leaking to the exterior of the housing that has been formed by fitting together the first housing member and the second housing member, and pump efficiency improves.

Moreover, the fitting face of the ring-shaped groove of the second housing member controls an inner diameter of the cylindrical wall at the open end of the first housing member. The shape of the cavity within the housing that has been formed by fitting together the first housing member and the second housing member is thus adjusted reliably to a predetermined shape. A configuration is thus realized in which, when the rotor and the separating member are rotating within this inner cavity, fluid cannot readily leak between the housing and the rotor, nor can it readily leak between the housing and the separating member. The divided spaces within the housing are secularly sealed therebetween.

It is preferred that the side portion of the second housing member is cylindrical and extends in a ring shape. It is preferred that a ring-shaped sealing member is fitted between the outer face of the cylindrical wall of the first housing member and an inner face of the cylindrical side portion of the second housing member.

In this case, the ring-shaped sealing member prevents fluid from leaking to the exterior of the housing formed by fitting together the first housing member and the second housing member. Furthermore, the ring-shaped sealing member operates so as to increase the diameter of the inner face of the ring-shaped groove formed in the sealing portion of the second housing member, and consequently the inner fitting face of the groove fits tightly with the inner face of the cylindrical wall of the first housing member. As a result, the degree of coaxiality increases of the cylindrical side portion of the second housing member and the cylindrical wall of the first housing member, there is a uniform degree of compression of the ring-shaped sealing member along its entire circumference, and the seal created by the sealing member is consequently uniform along the entire circumference.

It is preferred that a rotary shaft of the rotor extends towards the second housing member, and that a concave shaft receiving portion capable of supporting the rotary shaft is formed in the sealing portion of the second housing member.

In this case, the rotational run-out of the rotor is suppressed, and the positional relationship of the housing, the rotor, and the separating member is maintained. Consequently, a configuration is realized in which fluid cannot readily leak between the housing and the rotor, or between the housing and the separating member. Further, the rotational load of the rotor is reduced, and consequently the driving force of the pump can be reduced. Moreover, operating noise and vibration of the pump is reduced.

It is preferred that the rotary shaft of the rotor extends towards both axial ends of the rotor, and that a supporting groove formed in the rotor for supporting the separating member extends as far as both ends of the rotary shaft. That is, it is preferred that the supporting groove is exposed to both axial end faces of the rotor at a position where the rotary shaft is not formed.

In this case, the length of the separating member, in the direction of the rotary shaft of the rotor, can be greater than that of the rotor. Consequently, a state can be realized in which both axial ends of the separating member make contact with the housing even when both axial ends (except the rotary shafts) of the rotor do not make contact with the housing.

A configuration is realized in which liquid does not readily leak between the housing and the separating member at both axial ends of the separating member.

A pump is required for ink delivery in an ink jet printer. An ink jet printer having the pump of the present invention incorporated therein is capable of delivering ink in a stable manner, and enables high-quality printing.

BRIEF DESCRIPTION OF THE DRAWINGS

FIG. 3(*a*) shows a cross-sectional view showing a state where a cover member has not been fixed to a housing member, and FIG. 3(*b*) shows a cross-sectional view showing a state where the cover member has been fixed to the housing member.

FIG. 4(*a*) shows a case where intersecting portions are not formed in a curved face shape, and FIG. 4(*b*) shows an enlargement of a vicinity of the intersecting portions where a curved face shape is formed.

FIG. 6(*a*) shows the pump in a halted state, FIG. 6(*b*) and FIG. 6(*c*) show the pump in a rotating state.

FIG. 8(*a*) shows a case where a curved face is formed across a range of 80° of the rotor, and FIG. 8(*b*) shows a case where the curved face is formed across a range of 40° of the rotor.

DETAILED DESCRIPTION OF THE INVENTION

Preferred Embodiments to Practice the Invention

A preferred embodiment for practicing the present invention will now be described. In the present embodiment, the present invention has been applied to a line type color ink jet printer.

Figure 1:
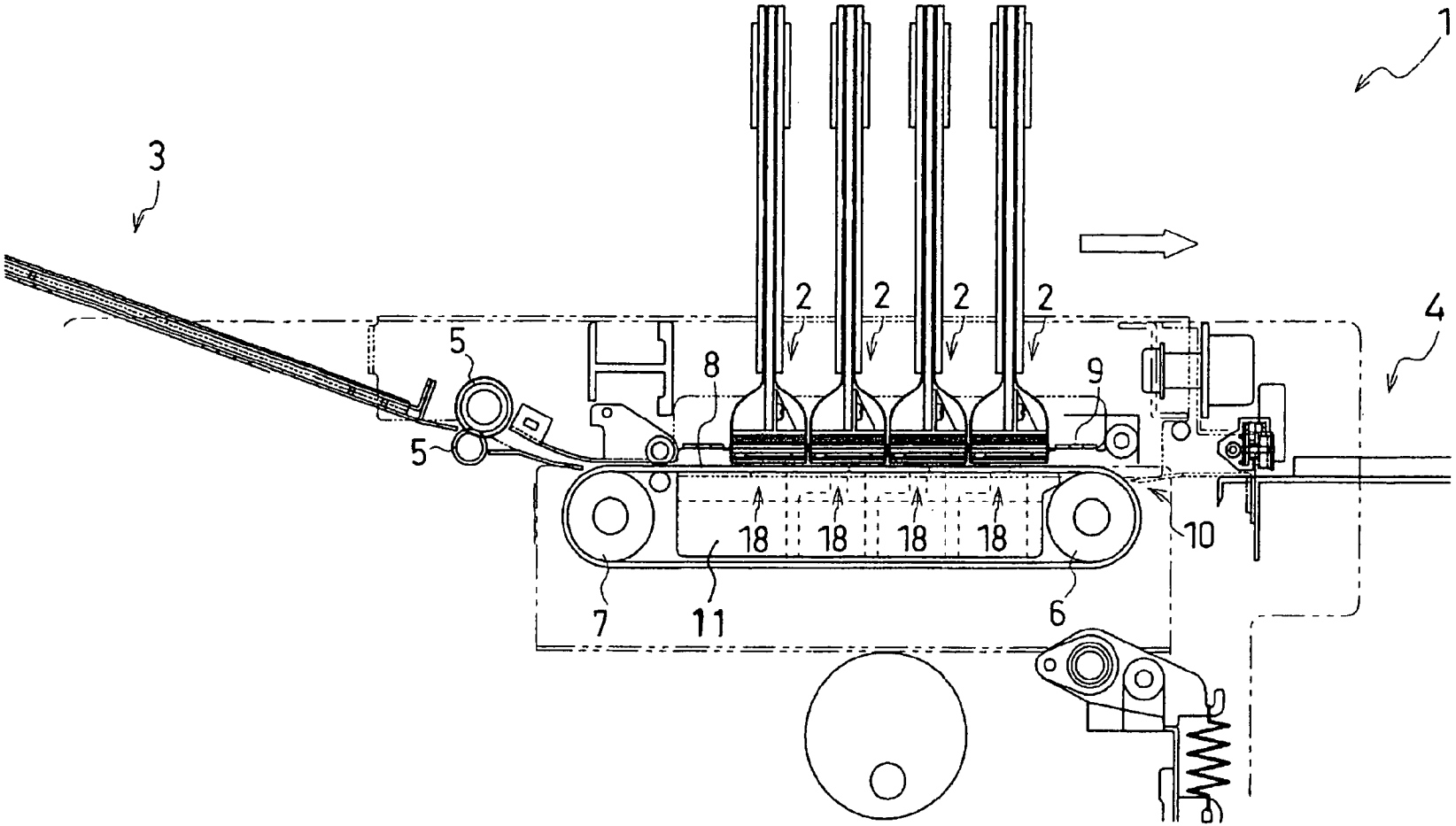
FIG. 1 shows a side view of an embodiment of an ink jet printer of the present embodiment.

As shown in FIG. 1, a color ink jet printer 1 has four ink jet heads 2. The ink jet printer 1 is provided with a paper delivery part 3 and a paper discharge part 4 at the left and right side respectively relative to FIG. 1. A paper carrier path is formed within the ink jet printer 1 between the paper delivery part 3 and the paper discharge part 4.

A pair of upper and lower delivery rollers 5 is disposed downstream from the paper delivery part 3. Paper (a recording medium) is held between these delivery rollers 5 and is delivered. The delivery rollers 5 deliver the paper from left to right relative to FIG. 1. The paper carrier path has two belt rollers 6 and 7 disposed therein, and an endless carrier belt 8 is wound between the belt rollers 6 and 7. Silicon processing has been performed on an outer face (a carrier face) of the carrier belt 8, and consequently the paper carried thereto by the pair of delivery rollers 5 remains on a surface face of the carrier belt 8 by means of adhesive force. The belt roller 6 is driven by motor not shown, thus carrying the paper downstream (towards the right) by means of the carrier belt 8. A pressing member 9 is located at a side opposite the belt roller 6 (the opposite side relative to the paper carrier path). The pressing member 9 presses the paper onto the carrier belt 8 so that the paper does not rise off the carrier face.

A lifting mechanism 10 is formed to the right, relative to FIG. 1, of the carrier belt 8. The lifting mechanism 10 lifts off the paper adhering to the carrier face of the carrier belt 8 and delivers it to the paper discharge part 4 at the right side. Further, a guide member 11 is disposed at an inner side of the carrier belt 8 at a location opposite the ink jet heads 2. That is, the guide member 11 makes contact with a lower face of an upper half of the carrier belt 8 and supports this carrier belt 8 from its inner circumference side. The guide member 11 has a rectangular parallelopiped shape.

The ink jet heads 2 are long along a direction orthogonal to the page of FIG. 1, and are rectangular from a plan view. Each ink jet head 2 corresponds to one of four colors of ink (magenta, yellow, cyan, and black) and the ink jet heads 2 are aligned so as to extend in the direction of delivery of the paper. A head main body 18 is provided at a lower end part of each ink jet head 2. The head main body 18 contains an ink passage unit and an actuator provided at a surface face of the ink passage unit. The ink passage unit is formed from an ink passage that includes a pressure chamber. The actuator elevates the pressure of ink within the pressure chamber. A plurality of nozzles is formed at lower faces of the head main bodies 18. These nozzles are linked with the ink passages in the head main bodies 18, and discharge ink towards the paper delivered by the carrier belt 8.

A minute space is formed between lower faces of the ink jet heads 2 and the carrier face of the carrier belt 8. This space forms the paper carrier path. When the paper is passed though this space between the four ink jet heads 2 and the carrier belt 8, ink of each color is discharged from the nozzles to an upper face (a printing face) of the paper. The desired color image is thus formed on the paper.

Next, an ink supply system for supplying ink to the ink jet heads 2 will be described with reference to FIG. 2.

Ink cartridges 20 for storing ink to be supplied to the ink jet heads 2 are mounted in the ink jet printer 1. Four ink cartridges 20 corresponding to the four ink colors (magenta, yellow, cyan, and black) are mounted.

Each ink cartridge 20 and each ink jet head 2 is linked via a pump 30 and a resilient tube 13. The tube 13 is formed from elastomer, and has considerable elasticity.

Figure 2:
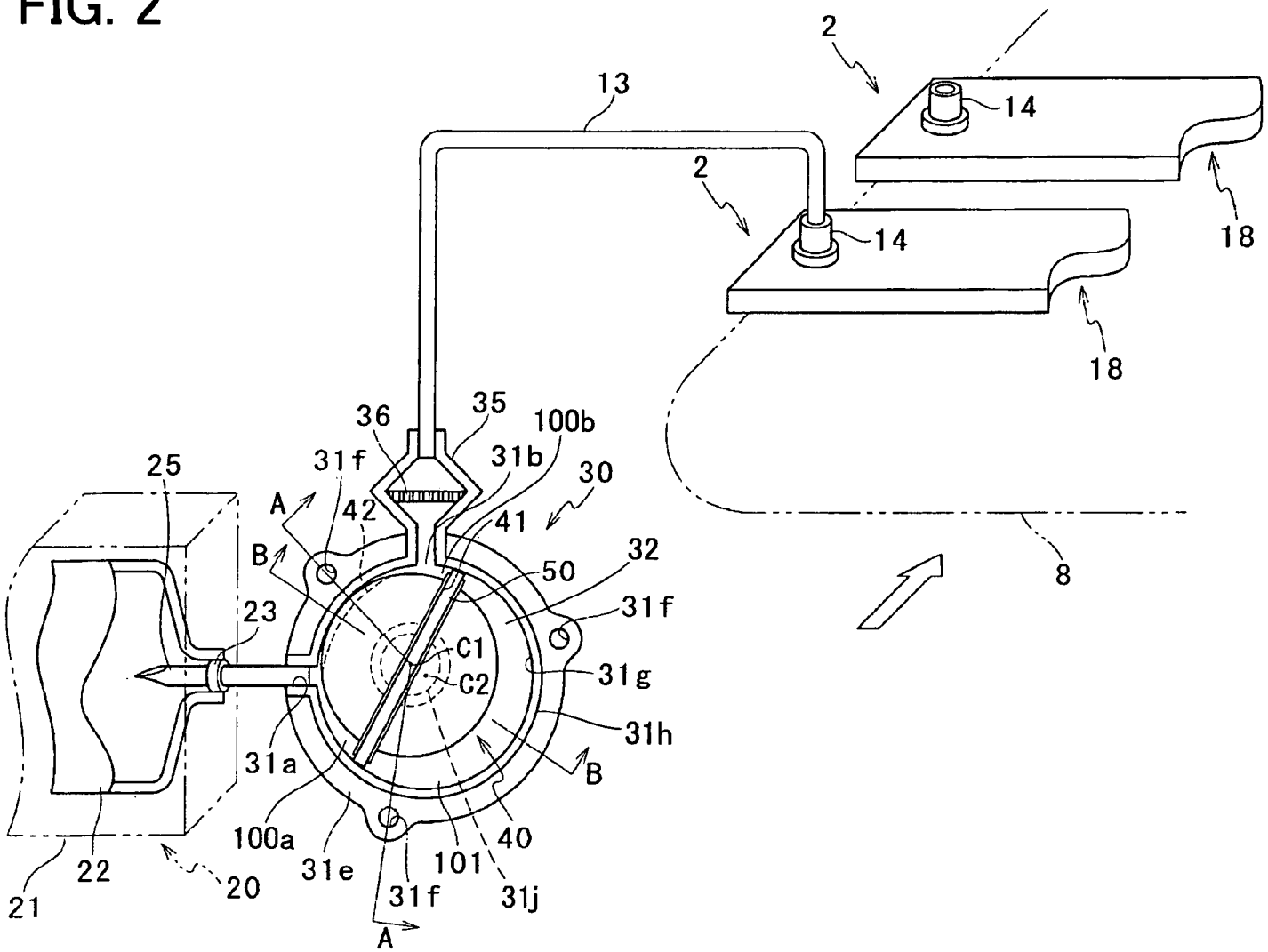
FIG. 2 shows a schematic block diagram of a ink supply system of the ink jet printer.

FIG. 2 shows only one ink cartridge 20, pump 30, and tube 13, these corresponding to one ink jet head 2. However, there are in fact four sets including the ink cartridge 20, pump 30, and tube 13.

As shown in FIG. 2, the ink cartridge 20 is provided with a cartridge main body 21 and an ink sack 22. The cartridge main body 21 is formed from synthetic resin. The ink sack 22 is provided within the cartridge main body 21. The ink sack 22 comprises a pouch film formed by thermo compression bonding a plurality of resilient films. Deaerated ink is stored in the ink sack 22. A polypropylene film is formed at an innermost side of the pouch film, a polyester film is formed at an outer side thereof, followed by an aluminum foil film, and then a nylon film. A resin spout is formed in the ink sack 22 for sealing an opening part thereof. This spout is provided with a cap 23 formed from silicone rubber or butyl rubber. When a hollow needle 25 (to be described) passes through the cap 23, the ink in the ink cartridge 20 is supplied to the ink jet head 2 via the pump 30 and the tube 13. Moreover, when the ink within the ink cartridge 20 has finished, the hollow needle 25 is removed from the cap 23, and the ink cartridge 20 can be exchanged.

A cylindrical ink supply port 14 is formed at an upper face of one end, relative to its longitudinal direction, of the head main body 18 of the ink jet head 2. One end of the tube 13 is connected with the ink supply port 14. The other end of the tube 13 is connected with the pump 30.

When the ink cartridge 20 is exchanged, air bubbles, etc. may be entrapped in the ink passage within the head main body 18. The pump 30 is operated so as to force the ink in the ink jet head 2 outwards, and thus discharge from the nozzles (i.e. purge) the air bubbles or the like trapped in the ink. It is necessary, in the purging operation, to discharge the air bubbles effectively while minimizing the quantity of ink wasted. The ink must therefore be forced outwards using a high current speed.

During printing, the actuator of the head main body 18 is operated and the ink is discharged. Discharging the ink decreases the pressure in the ink passage within the head main body 18, thus drawing ink into this ink passage. Since ink feeds into the head main body 18 during printing, there is no need to operate the pump 30. A passage 43 (see FIGS. 3(*a*) and (*b*), and FIG. 4(*a*)) is formed within the pump 30 to allow the passage of ink when the pump 30 is not rotating. During printing, when the pump 30 is in a halted state, the ink in the ink cartridge 20 passes through the pump 30 and the tube 13, passes through the ink passage formed in the head main body 18, and is discharged from the nozzle.

Figure 3:
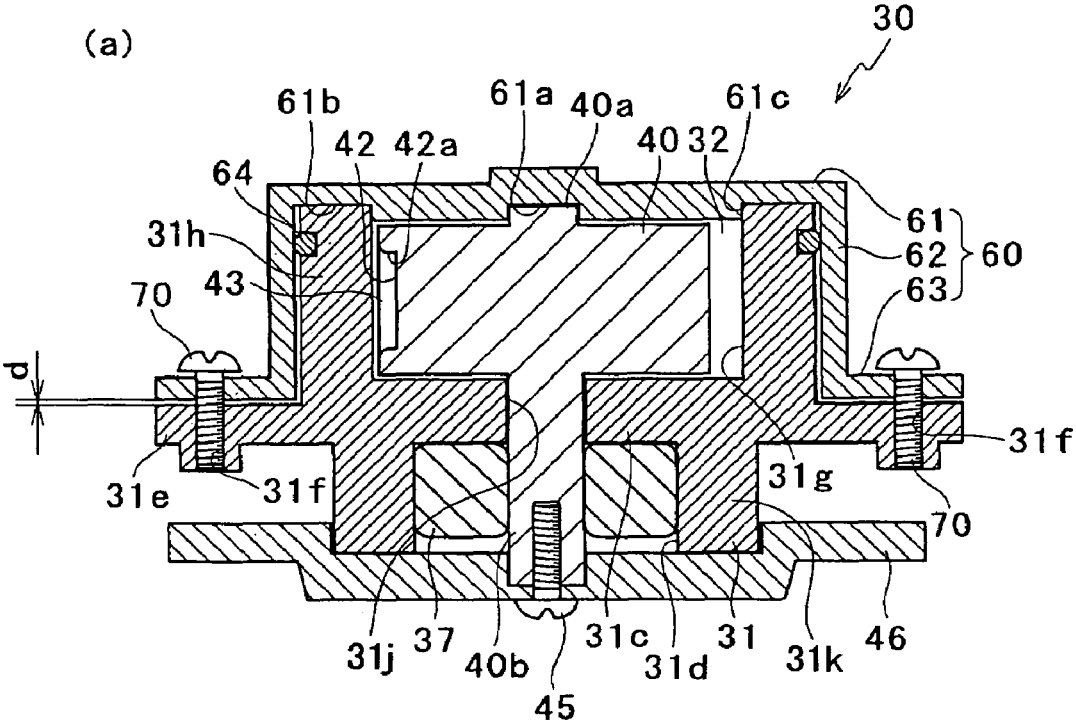
FIG. 3 shows cross-sectional views along the line A-A of the pump shown in FIG. 2.
Figure 3:
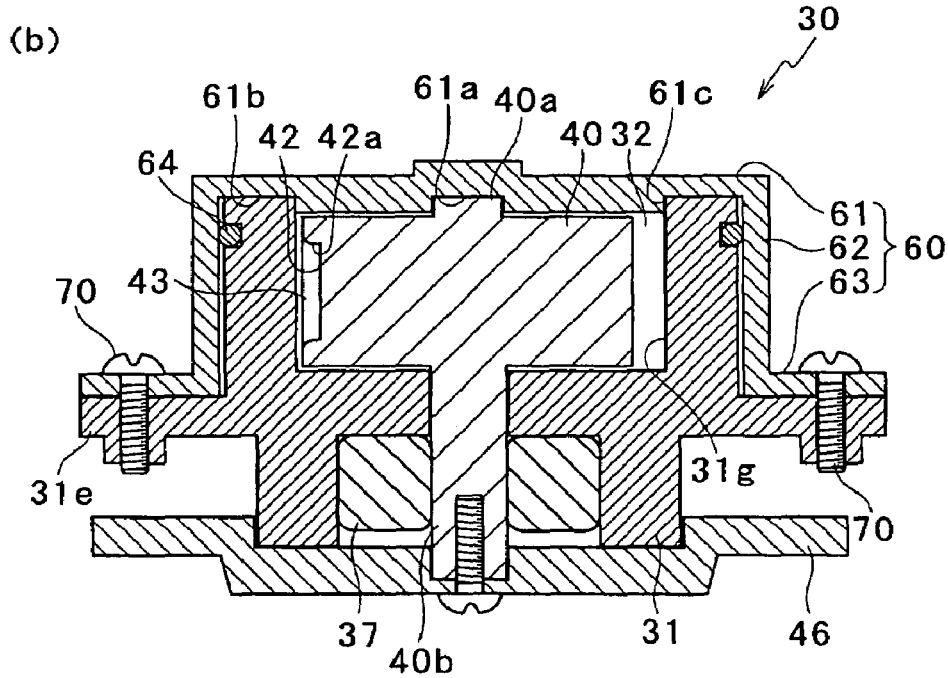

Next, the pump 30 will be described in detail. As shown in FIGS. 3(*a*) and (*b*), the pump 30 is provided with a housing member 31 (first housing member), a cover member 60 (second housing member), a rotor 40, a separating member 50, and screws 70 (fixing means). The pump 30 in FIG. 2 is shown in a state in which the cover member 60 has been removed. Furthermore, FIG. 3 (a) is a cross-sectional view along the line A-A of FIG. 2 showing a state where the cover member 60 is not fixed to the housing member 31. FIG. 3(*b*) is a cross-sectional view along the line A-A of FIG. 2 showing a state where the cover member 60 is fixed to the housing member 31.

The housing member 31 is injection molded from synthetic resin. The housing member 31 has the following: a cylindrical wall 31*h* having a cavity 32 therein, an inlet port 31*a* and an outlet port 31*b* that pass through the cylindrical wall 31*h* (see FIG. 2), a base 31*c* formed at a lower end of the cylindrical wall 31*h*, a fixing part 31*e* that extends horizontally in a collar shape from the base 31*c*, and a cylindrically-shaped wall 31*k* that extends downwards from the base 31*c*. An upper end of the cylindrical wall 31*h* is open.

The inlet port 31*a* is formed in the cylindrical wall 31*h* of the housing member 31 at a location opposite the cap 23 of the ink cartridge 20. The hollow needle 25, which is made from metal, fits into the inlet port 31*a*. The inlet port 31*a* is linked with the ink cartridge 20 via this hollow needle 25. The end of the hollow needle 25 at its ink cartridge 20 side is sharp and has been cut obliquely. As shown in FIG. 2, the hollow needle 25 fitted into the inlet port 31*a* passes through the cap 23 of the ink cartridge 20, and the ink in the ink cartridge 20 is drawn, via the hollow needle 25, from the inlet port 31*a* into the cavity 32.

The outlet port 31*b* is formed in the cylindrical wall 31*h* of the housing member 31 at a location approximately 270°, in an anticlockwise direction of FIG. 2, from the inlet port 31*a* (located at an upper end of the housing member 31 in FIG. 2). A filter housing part 35 is formed integrally with the housing member 31. The filter housing part 35 is linked with the outlet port 31*b* and houses a filter 36. One end of the tube 13 is connected with the filter housing part 35. The outlet port 31*b* is thus linked with the ink jet head 2 via the filter housing part 35 and the tube 13. The filter housing part 35 has a diamond shape in vertical cross-section, and a mesh-shaped filter 36 is housed therein. The filter 36 filters the ink being supplied from the ink cartridge 20 to the ink jet head 2. The filter 36 captures and removes from the ink, for example, rubber residue that is created when the hollow needle 25 is pushed through the cap 23 or when the hollow needle 25 is removed therefrom at the time when the ink cartridge 20 is attached or removed. It is no longer necessary to provide a filter at the ink cartridge 20 side, and the configuration of the ink cartridge 20 can thus be simplified.

The base 31*c* is formed at the lower end of the cylindrical wall 31*h* of the housing member 31. A shaft receiving hole 31*j* is formed in the base 31*c*. The shaft receiving hole 31*j* receives a rotating shaft 40*b* at a lower side of the rotor 40 (to be described). In FIG. 2, the shaft receiving hole 31*j* is formed at an off-center location extending obliquely upwards and to the left from a center C2 of the cavity 32.

As shown in FIG. 3, the fixing part 31*e* that extends horizontally in a collar shape to an outer side of the cylindrical wall 31*h* is formed at the same height as the base 31*c*. As shown in FIG. 2, screw holes 31*f* are formed at three equidistant locations along the circumference of the fixing part 31*e*.

The housing member 31 is provided with the cylindrically-shaped wall 31*k* that extends downwards from the base 31*c*. An oil seal 37 is housed within the cylindrically-shaped wall 31*k*.

The rotor 40 is formed in a cylindrical shape and is somewhat shorter in the axial direction (the up-down direction of FIG. 3) than the cavity 32. Rotating shafts 40*a* and 40*b* are formed integrally at an upper and a lower end (relative to FIG. 3) respectively of the rotor 40. The upper rotating shaft 40*a* is supported in a manner allowing rotation in a concave shaft receiving member 61*a* formed in a sealing portion 61 of the cover member 60 (to be described). The lower rotating shaft 40*b* is inserted into, and supported in a manner allowing rotation, in the shaft receiving hole 31*j* formed in the base 31*c* of the housing member 31. Both upper and lower ends of the rotor 40 are supported in a manner allowing rotation and the rotor 40 can rotate freely within the cavity 32 of the housing member 31. As shown in FIG. 2, a rotational center C1 of the rotor 40 is in an off-center location obliquely upwards and to the left from the center C2 of the cavity 32. An outer peripheral surface of the rotor 40 (in fact, a portion of the outer peripheral surface that does not have a curved face 42, to be described) makes contact with an inner face 31*g* of the cylindrical wall 31*h* of the housing member 31 at a location downstream from the outlet port 31*b* and upstream from the inlet port 31*a* (upstream and downstream in relation to an anticlockwise direction of the rotor, this rotor rotating in the anticlockwise direction relative to FIG. 2).

As shown in FIG. 3, a gear 46 is fixed by means of a screw 45 to a lower end of the rotating shaft 40*b*. The gear 46 is connected with a driving motor (not shown) that consists of a stepping motor. Driving force of the driving motor is transmitted to the rotating shaft 40*b* via the gear 46, thus driving the rotation of the rotor 40.

The oil seal 37 is provided between the rotating shaft 40*b* and the housing member 31. The oil seal 37 prevents lubricating oil applied to the gear 46, etc. from entering into the cavity 32. Furthermore, the oil seal 37 prevents the ink within the cavity 32 from leaking to the exterior.

Figure 4:
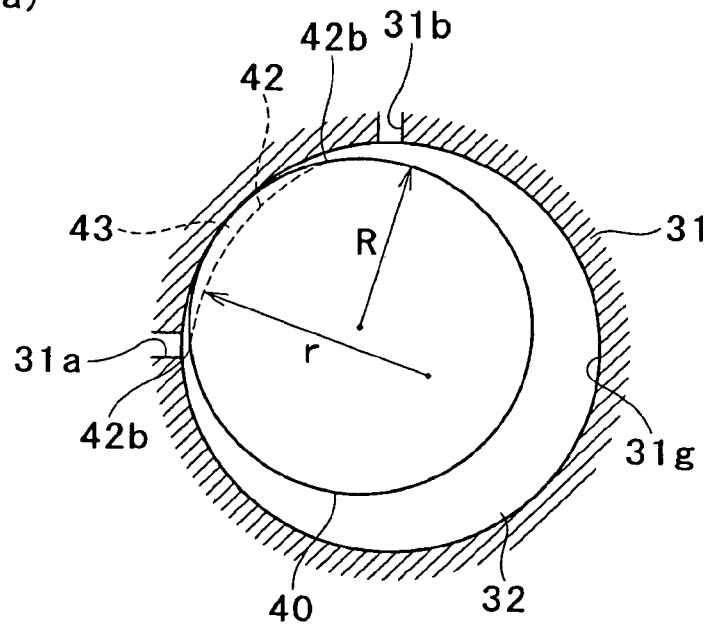
FIG. 4 shows schematic views of a rotor provided with a curved face.
Figure 4:
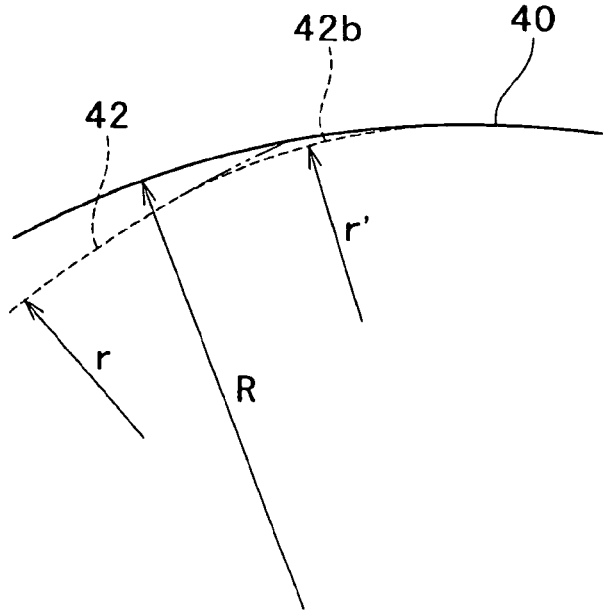

As shown in FIGS. 2 to 4, the curved face 42 that has a larger radius of curvature than the rotor 40 is formed at a limited circumferential angular region of an outer peripheral surface of the rotor 40. The pump 30, when it is to be halted, is halted by means of the stepping motor with the rotor being at an angle such that the curved face 42 faces the inner face 31*g* of the housing member 31 at a position that is downstream from the outlet port 31*b* and upstream from the inlet port 31*a* (see FIG. 4(*a*) and FIG. 6(*a*)). When the pump 30 is in the halted state, a passage 43 is formed between the curved face 42 of the rotor 40 and the inner face 31*g* of the housing member 31. The passage 43 links the inlet port 31*a* and the outlet port 31*b*.

The passage 43 links the ink cartridge 20 and the ink jet head 2 when the pump 30 is not being driven. When paper is to be printed, ink is delivered from the ink cartridge 20 to the ink jet head 2 even when the pump 30 is not moving.

As shown in FIG. 3, the curved face 42 is formed at a part-way portion (middle portion) in the outer peripheral surface of the rotor 40 in the axial direction of the rotor 40. The upper and lower ends of the rotor 40 are complete circular in their cross sections. The curved face 42 forms a concave shape between the upper and lower ends of the rotor 40. While rotating, the upper and lower ends of the rotor 40 continually make contact with the inner face 31*g* of the housing member 31. This inner face 31*g* guides the upper and lower ends of the rotor 40. As a result, the rotor 40 can rotate smoothly at high speed.

As shown in FIG. 3, angled portions 42*a* (stepped or corner portions) of the concave shape of the curved face 42 of the rotor 40 are formed—observed from a cross-section that includes a rotary shaft of the rotor 40—with a prescribed radius of curvature. Contact resistance between the rotor 40 and the housing member 31 is thus reduced.

The amount of force required to rotate the rotor 40 by a unit angle changes depending on the angle of rotation of the rotor 40. The curved face 42 is formed in the concave shape in the outer peripheral surface of the rotor 40 along a limited divided region of the circumference direction thereof. The angle of the outer peripheral surface of the rotor 40 having the curved face 42 with respect to the housing member 31 is thus changed, and the amount of force required to rotate the rotor is thus changed also.

As shown in FIG. 4(*b*), it is preferred that the portions 42*b*, where the outer peripheral surface of the rotor 40 and the curved face 42 intersect, are smoothly joined by a curved face having a prescribed radius of curvature r'. In FIG. 4(*b*), a state in which the intersecting portions 42*b* are not formed in a curved face shape is shown by a two-dot chain line. The smooth join between the outer peripheral surface of the rotor 40 and the curved face 42 suppresses the degree of change of the force for rotating the rotor 40, and consequently the rotor 40 rotates smoothly.

Figure 5:
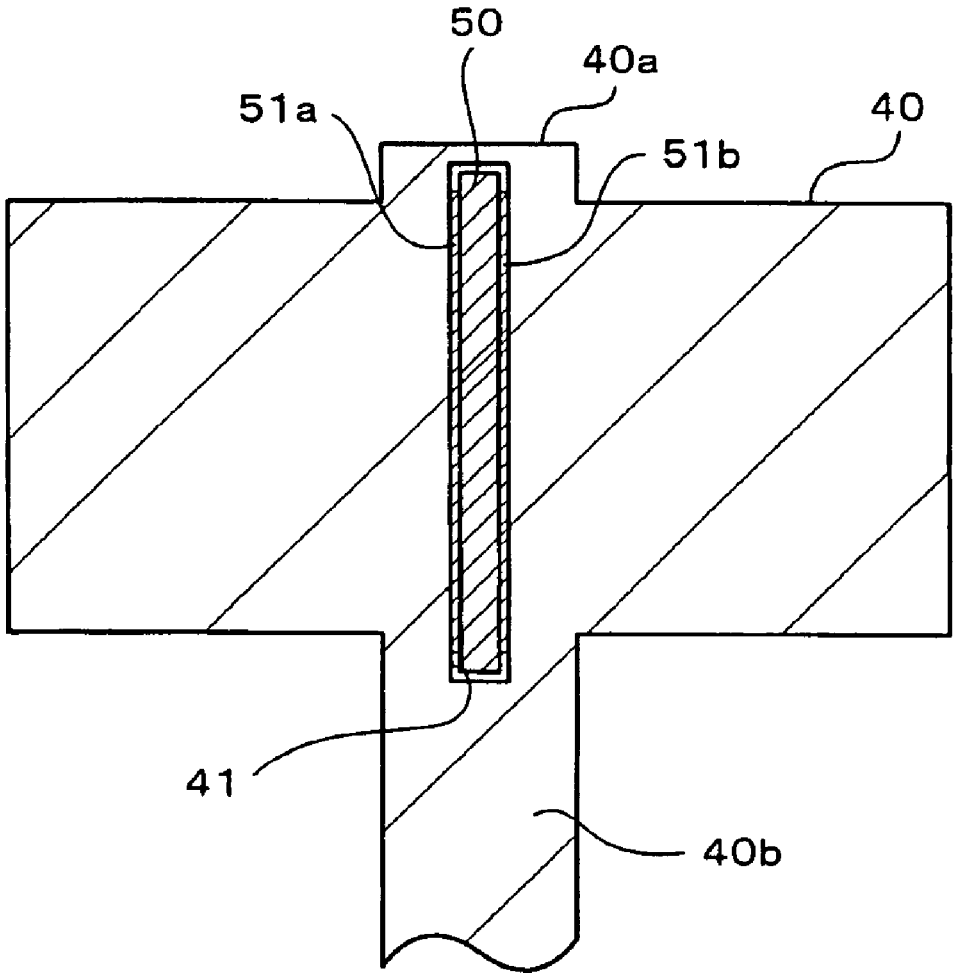
FIG. 5 shows a cross-sectional view along the line B-B of the rotor shown in FIG. 2.

As shown in FIGS. 2 and 5, a retaining groove 41 for retaining the separating member 50 passes in a radial direction through the rotor 40. The retaining groove 41 also passes through the rotor 40 in the axial direction, extends to the rotating shafts 40*a* and 40*b*, and is exposed at both axial end faces of the rotor 40 except the rotating shafts 40*a* and 40*b*.

The separating member 50 and two sliding members 51*a* and 51*b*, these having the separating member 50 sandwiched therebetween, are inserted in an overlapping state into the retaining groove 41. The separating member 50 is formed from synthetic rubber EPDM (ethylene propylene diene terpolymer), and is resilient. The sliding members 51*a* and 51*b* are formed from POM (polyoxymethylene) resin, and have a low coefficient of friction with respect to both the separating member 50 and the rotor 40. The separating member 50 that is sandwiched between the two sliding members 51*a* and 51*b* is located within a plane that includes the center C1 of the rotor 40, and rotates integrally with the rotor 40.

The separating member 50 has a rectangular plane shape. As shown in FIG. 2, when the separating member 50 has been inserted into the retaining groove 41, the separating member 50 projects in a radial direction beyond the outer peripheral surface of the rotor 40, and its protruding ends make contact with the inner face 31*g* of the housing member 31. The elasticity of the separating member 50 presses the protruding ends of the separating member 50 against the inner face 31*g*.

The separating member 50 also protrudes in the axial direction of the rotor 40 from the end face (relative to the axial direction) of the rotor 40. A lower protruding end of the separating member 50 makes contact with the base 31*c* of the housing member 31, and an upper protruding end thereof makes contact with the cover member 60. The elasticity of the separating member 50 presses its protruding lower end against the base 31*c* and presses its protruding upper end against an inner face of the cover member 60.

As shown in FIG. 2, a cavity 32 within the housing member 31 is separated by the separating member 50 and the rotor 40 into: a divided space 100*a* linked with the inlet port 31*a*, a divided space 101 linked with neither the inlet port 31*a* nor the outlet port 31*b*, and a divided space 100*b* linked with the outlet port 31*b*. The separating member 50 protrudes in the radial direction beyond the outer peripheral face of the rotor 40, and makes contact with the inner face 31*g* of the housing member 31. Furthermore, the separating member 50 protrudes in the axial direction beyond the axial end faces of the rotor 40, and makes contact with the base 31*c* of the housing member 31 and the inner face of the cover member 60. An outer peripheral portion of the rotor 40 that is not provided with the curved face 42 makes contact with the inner face 31*g* of the housing member 31 between the inlet port 31*a* and the outlet port 31*b*.

Ink can reliably be prevented from leaking between the divided spaces 100*a*, 101, and 100*b* which are separated by the rotor 40 and the separating member 50.

When the curved face 42 of the rotor 40 is in a range that is downstream from the outlet port 31*b* and upstream from the inlet port 31*a*, the passage 43 links the divided spaces 100*a* and 100*b*. When the curved face 42 of the rotor 40 is not in the aforementioned range, the divided spaces 100*a*, 101, and 100*b* are reliably separated by the separating member 50 and the rotor 40.

Like the separating member 50, the two sliding members 51*a* and 51*b* have a rectangular plane shape. However, the sliding members 51*a* and 51*b* are shorter, relative to the radial direction of the rotor 40, and thinner than the separating member 50. Furthermore, the members 51*a* and 51*b* are formed from synthetic resin, and consequently they have a lower coefficient of friction while sliding, with respect to the retaining groove 41, than the separating member 50. The separating member 50 is disposed within the retaining groove 41 while being sandwiched between the sliding members 51*a* and 51*b*. Consequently, the low coefficient of friction of the members 51*a* and 51*b* allows the separating member 50 to slide within the retaining groove 41 smoothly. Smooth sliding of the separating member 50 along the diameter of the rotor 40 secures tight contact between the protruding ends of the separating member 50 and the inner face 31*g*. The separating member 50 thus slides smoothly with respect to the housing member 31 while the rotor 40 is rotating. The separating member 50 also slides smoothly with respect to the base portion 31*c* and the cover member 60. The separating member 50 maintains tight contact with the inner faces defining the cavity 32 while the rotor 40 is rotating.

The cover member 60 is formed from synthetic resin by means of injection molding. As shown in FIG. 3, the cover member 60 has the sealing portion 61, a side portion 62, and a connecting portion 63. The sealing portion 61 is fitted tightly with an upper portion (upper relative to FIG. 3 of the housing member 31), and covers the cavity 32. The side portion 62 is cylindrical and extends from the sealing portion 61 to a lower end side, relative to FIG. 3, of the housing member 31, thus covering side faces of the housing member 31. The connecting portion 63 is formed at a lower end of the side portion 62 and extends horizontally in a collar shape. The cover member 60 is formed in a cap shape and covers an upper half of the housing member 31.

The sealing portion 61 corresponds to a top portion of the cap-shaped cover member 60, and has a plane disc shape. The concave shaft receiving portion 61*a*, in which the upper rotating shaft 40*a* of the rotor 40 can be supported, is formed in an inner side (the rotor 40 side) of the sealing portion 61.

As described earlier, the lower rotating shaft 40*b* of the rotor 40 is supported by the shaft receiving hole 31*j* of the housing member 31. The rotor 40 rotates while being supported from both axial sides. The rotational run-out of the rotor 40 is thus suppressed, this reducing the rotational load of the rotor 40 and thus increasing the output efficiency of the pump 30. Operating noise or vibration of the pump 30 is also reduced. Further, if the rotor 40 and the housing member 31 are maintained in the above positional relationship, ink can reliably be prevented from leaking between the divided spaces 100*a* and 100*b* that are separated by the rotor 40 and the separating member 50 (with the exception of the case where the passage 43 is formed by means of the curved face 42).

A ring-shaped concave groove 61*b* is formed along a periphery of the shaft receiving portion 61*a* of the sealing portion 61. The ring-shaped groove 61*b* is concave relative to the upwards direction of FIG. 3, and an upper end part of the cylindrical wall 31*h* of the housing member 31 is housed therein. A fitting face 61*c* is formed at an inner face of the concave groove 61*b*. An inner face of the upper end part of the cylindrical wall 31*h* of the housing member 31 fits tightly with the inner fitting face 61*c* of the cover member 60 and thus reliably prevents ink within the cavity 32 from leaking to the exterior.

The side portion 62 of the cover member 60 extends from an outer periphery of the sealing portion 61 to the fixing part 31*e* of the housing member 31, and covers the side face of the upper portion of the housing member 31. A resilient O ring 64 (a sealing member) is attached between the side portion 62 and the side face of the housing member 31. The O ring 64 reliably prevents ink from leaking out to the exterior of the pump 30 through the space between the side face of the housing member 31 and the side portion 62 of the cover member 60. The fitting face 61*c* is formed at the inner face of the concave groove 61*b* and fits tightly with the inner face of the upper end part of the housing member 31. There is consequently a uniform space between the side portion 62 and the housing member 31 along the entire circumference thereof. There is thus also a uniform degree of compression along the entire circumference of the O ring 64, and the seal created by the O ring 64 is consequently uniform. Furthermore, the elasticity of the O ring 64 exerts a diameter-increasing force upon the side portion 62. As a result, tensile force operates to increase the diameter of the fitting face 61*c* of the sealing portion 61. This results in the fitting face 61*c* being pushed uniformly onto the inner face of the upper end part of the housing member 31, resulting in the cover member 60 fitting uniformly with the inner circumference face of the housing member 31.

The plane face of the collar-shaped connecting portion 63 is formed in approximately the same shape as the fixing part 31*e* of the housing member 31, and is fixed to this fixing part 31*e* by means of the three screws 70 disposed at three equidistant locations along its circumference. Fixing the cap-shaped cover member 60 to the housing member 31 by means of these three equidistant screws 70 means that uniform force is operated upon the sealing portion 61, and the sealing portion 61 consequently fits tightly with the upper part of the housing member 31 along its entire circumference. Further, as shown in FIG. 3(*a*), when the cover member 60 is not fixed to the housing member 31, the connecting portion 63 is above the fixing part 31*e* and is separated therefrom by a minute space "d". The screws 70 extend parallel to the rotary shaft of the rotor, and the space "d" is reduced to zero when the connecting portion 63 and the fixing part 31*e* are brought together by means of tightening the screws 70. That is, when the cover member 60 is fixed to the housing member 31 by means of the three screws 70, the connecting portion 63 is pulled forcibly towards the fixing part 31*e* and is fixed thereto. As a result, a tensile force operates on the side portion 62, and a compressing force operates on the cylindrical wall 31*h* of the housing member 31. The sealing portion 61 is pushed against, and reliably fitted with, the upper end part of the housing member 31, thus reliably preventing ink in the cavity 32 from leaking to the exterior.

The upper end of the housing member 31 is open, and the inner face 31*g* of the cylindrical wall 31*h* of the housing member 31 can easily deviate from being circular due to distortion during molding, or the like. As shown in FIG. 3, the inner face of the upper end part of the cylindrical wall 31*h* is pushed into the fitting face 61*c* at the inner side of the concave groove 61*b* formed in the sealing portion 61. The inner face 31*g* thus follows the shape of the fitting face 61*c*. The shape of the cavity 32 within the housing member 31 is thus adjusted reliably. When the rotor 40 and the separating member 50 are rotating within the cavity 32, fluid cannot readily leak between the divided spaces 100*a*, 101, and 100*b* separated by the rotor 40 and the separating member 50 within the housing formed by the housing member 31 and the cover member 60. The housing structure is suitable for preventing the ink from leaking between the divided spaces 100*a*, 101, and 100*b* (with the exception of the case where the passage 43 is formed by means of the curved face 42 between the divided spaces 100*a* and 100*b*). The housing structure is also suitable for preventing the ink from leaking to the outside of the housing formed by the housing member 31 and the cover member 60.

Next, the operation of the pump 30 will be described.

Figure 6:
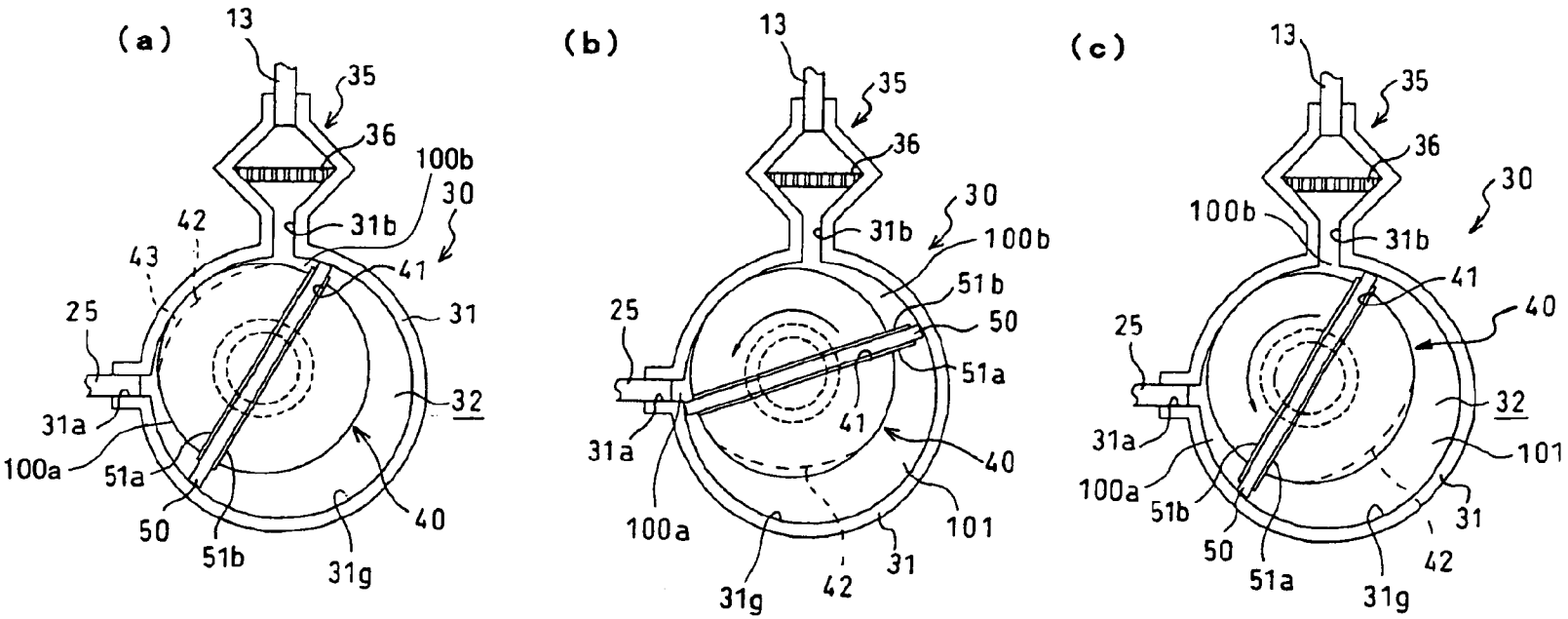
FIG. 6 shows the states of the pump during a printing operation and during a purging operation.

In the case where paper is being printed by means of the ink jet head 2, the stepping motor halts the rotor 40 of the pump 30 in the location of FIG. 6(*a*). The passage 43 is maintained between the curved face 42 of the rotor 40 and the inner face 31*g* of the housing member 31 when the pump 30 is halted, this passage 43 linking the inlet port 31*a* and the outlet port 31*b*. In this state, the ink in the ink cartridge 20 is supplied to the ink jet head 2 via the passage 43 in the pump 30 and via the tube 13, and the ink is discharged onto the paper from the nozzle of the ink jet head 2.

If the ink cartridge 20 has been changed, etc., an air bubble or the like may be entrapped in the ink. When this air bubble is to be expelled (purged), the driving force of the driving motor is transmitted to the rotor 40 via the gear 46 and the rotor 40 begins to rotate in an anti-clockwise direction from the state shown in FIG. 6(*a*). Thereupon, as shown in FIG. 6(*b*), the portion of the rotor 40 that does not have the curved face 42 makes contact with the inner face 31*g* of the housing member 31, and the passage 43 linking the inlet port 31*a* and the outlet port 31*b* is closed. The divided space 100*a* linked with the inlet port 31*a* and the divided space 100*b* linked with the outlet port 31*b* are separated by the rotor 40 that is making contact with the inner face 31*g*.

Furthermore, as shown in FIG. 6(*c*), when the rotor 40 rotates in the direction shown by the arrow, the divided space 100*a* linked with the inlet port 31*a* grows larger, the pressure of the ink within the divided space 100*a* decreases, and ink is consequently drawn therein from the ink cartridge 20. Conversely, as the rotor 40 rotates, the divided space 100*b* linked with the outlet port 31*b* grows smaller, the ink within the divided space 100*b* is compressed and is forced outwards from the outlet port 31*b* to the ink jet head 2. The ink in the ink cartridge 20 is thus forcibly delivered to the ink jet head 2 by means of the pump 30. Consequently, the air bubble trapped in the ink passage of the head main body 18 can be purged together with the ink.

As stated earlier, the amount of force required to rotate the rotor 40 changes depending on the angle of rotation of the rotor 40 with respect to the housing member 31. The passage 43 is maintained by forming the concave shape 42 in the outer peripheral surface of the rotor 40 along a limited angular region along the circumference direction. The angle of the location having this concave shape 42 with respect to the housing member 31 is thus changed while the rotor 40 is rotated, and the amount of force required to rotate the rotor 40 is thus changed depending on the angle of the location having the concave shape 42 with respect to the housing member 31.

Figure 7:
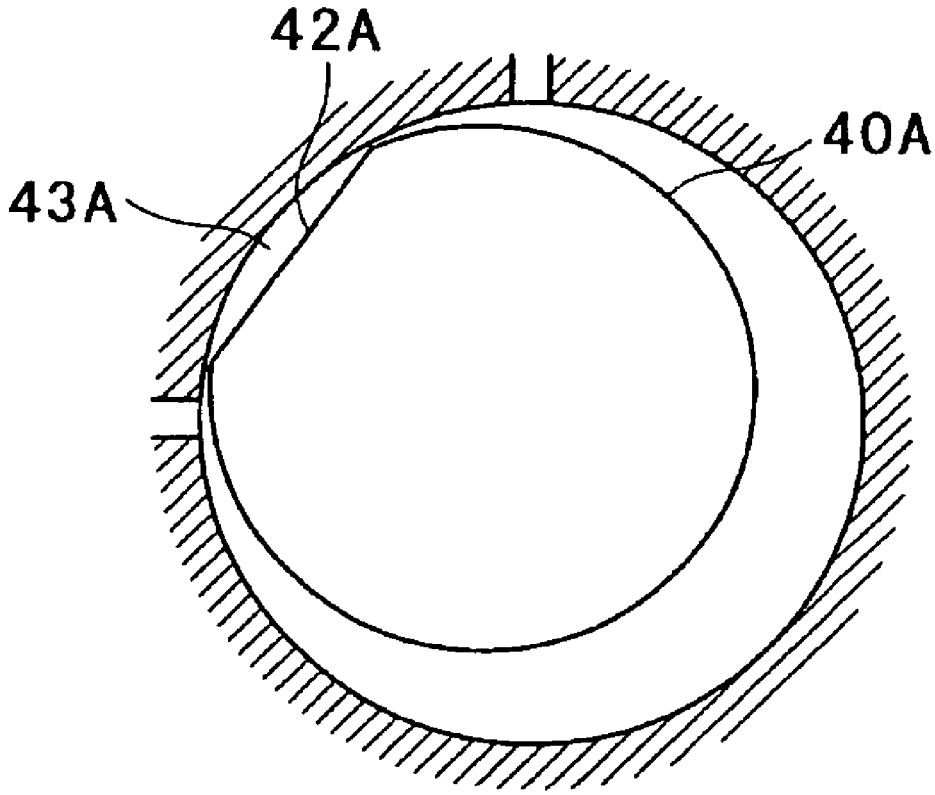
FIG. 7 shows a schematic view of a rotor provided with a plane cut-away portion.

As shown in FIG. 7, a passage 43A can be maintained by forming a plane cut-away portion 42A at the outer peripheral surface of the rotor 40A. If this is done, however, there is a rapid change in the amount of force required to rotate the rotor 40A depending on the angle of the location having the cut-away portion 42A with respect to the housing member 31. It is difficult for the rotor 40A to rotate smoothly, and the stepping motor driving the rotation of the rotor 40A can readily become out of step.

The above phenomenon is suppressed when the passage 43 is formed by the curved face 42 having a larger radius of curvature then the rotor 40. There is little change in the force required to rotate the rotor 40 while the angle of the cut-away portion 42 with respect to the housing member 31 is changed during the rotation of the rotor 40, and the rotor 40 can rotate smoothly. Since the stepping motor driving the rotation of the rotor 40 does not readily become out of step, the rotor 40 can rotate at high speed.

Further, if the passage 43 is formed by the curved face 42, there is little resistance in the passage 43 when the pump 30 is halted (the state shown in FIG. 6(*a*)). Consequently ink can be supplied smoothly to the ink jet head 2 while printing is being performed.

Figure 8:
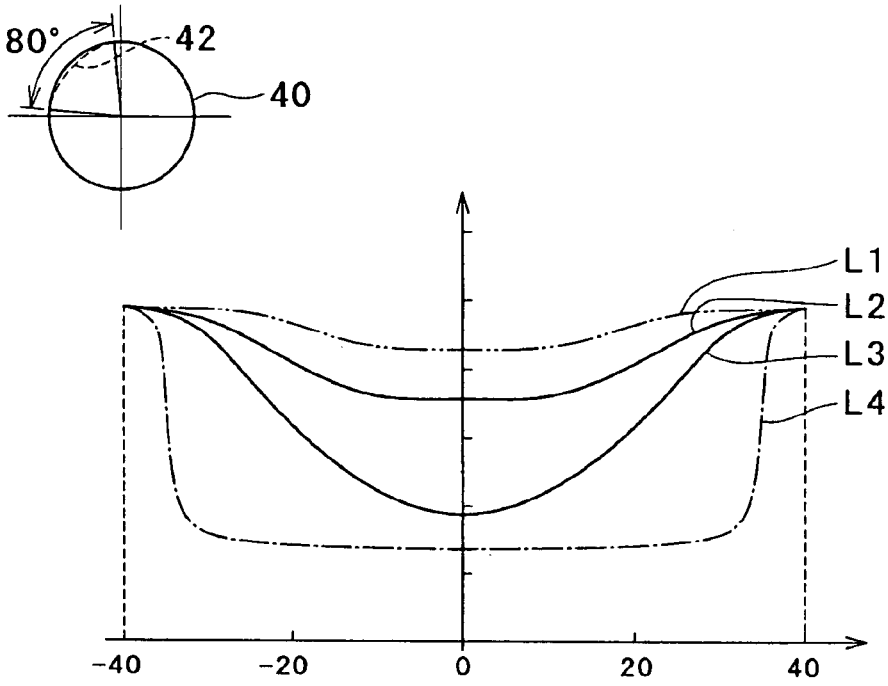
FIG. 8 shows the relationship between the rotational angle of the rotor and resistance in a passage.
Figure 8:
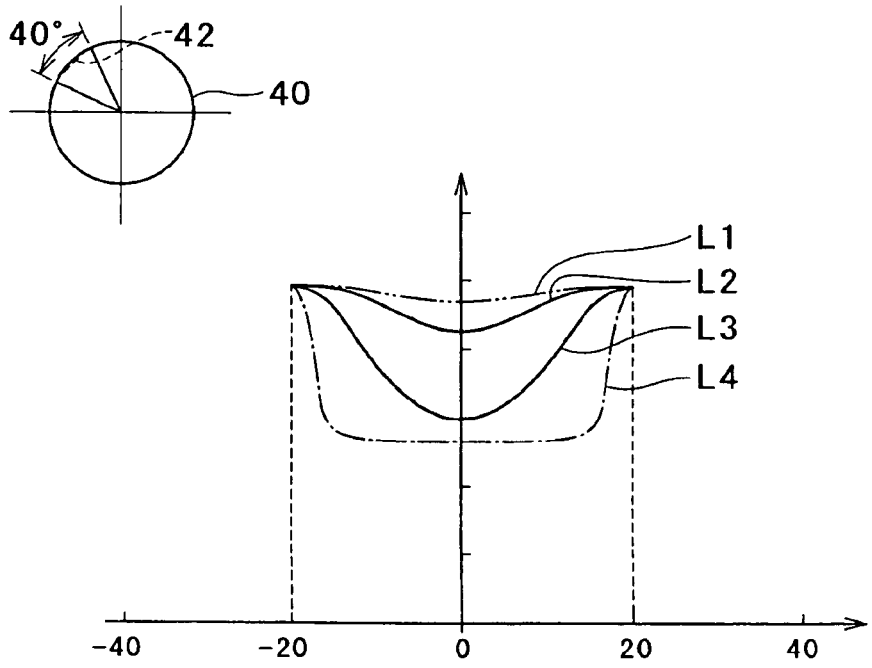
Figure 9:
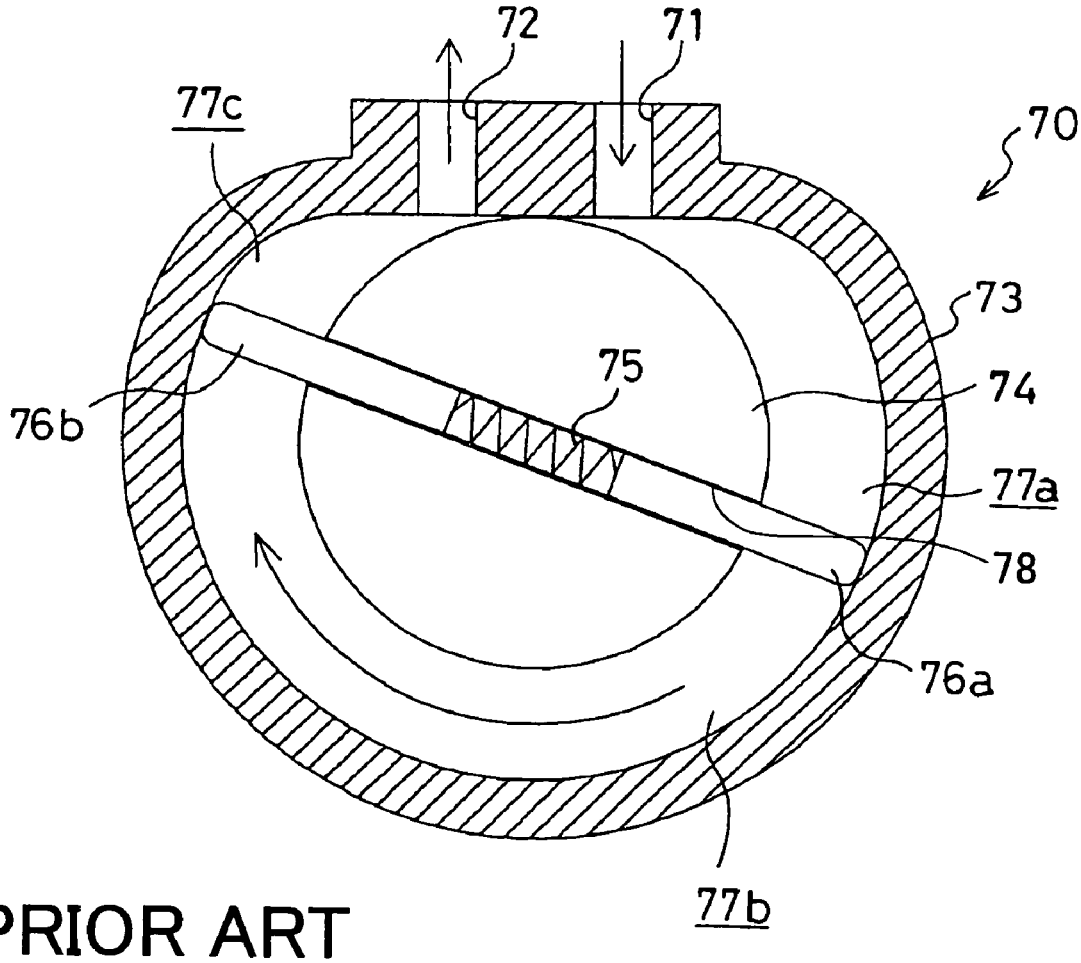
FIG. 9 shows a cross-sectional view of a conventional Cary's rotary pump.

Resistance in the passage 43 was measured in the case where the curved face 42 was formed across a divided region of 80° of the outer peripheral surface of the rotor 40. In the following, the radius of curvature of the rotor 40 is R, and the radius of curvature of the curved face 42 is r. The resistance in the passage from the inlet port 31*a* to the outlet port 31*b* was measured while the angle of rotation of the rotor 40 was varied (−40 to +40°). The results are shown in FIG. 8(*a*). A state in which the angle of rotation of the rotor 40 is 0° indicates that a central part, relative to the circumference direction, of the curved face 42 is nearest to the middle point of the inner face 31*g* of the housing member 31 between the inlet port 31*a* and the outlet port 31*b*, and the inlet port 31*a* and the outlet port 31*b* are linked (see FIGS. 4(*a*) and 6(*a*)). The angle of rotation of the rotor 40 is plus when in an anti-clockwise direction from the 0° state, and minus when in a clockwise direction from the 0° state. Further, in FIG. 8(*a*), a curve L1 shows a case where the radius of curvature r of the curved face 42 and the radius of curvature R of the rotor 40 are approximately identical (Almost no cut-away is formed). The curve L2 shows a case where the ratio r/R is 1.1, and the curve L3 shows a case where the ratio r/R is 1.3. The curve L4 is a line showing the relationship between the angle of rotation of the rotor and resistance in the passage for the case shown in FIG. 7, in which the plane cut-away portion 42A is formed in a rotor 40A. The specific values of resistance in the passage vary based on the radius of curvature r, the radius of curvature R and diameter of the rotor 40, as well as the inner diameter of the housing member 31. The specific values of resistance also change depending on the longitudinal length of the curved face 42, however, the longitudinal length of the curved face 42 does not have direct influence to the carved line shape between the resistance in the passage and the rotational angle of the rotor 40.

As shown in FIG. 8(*a*), in the case where the radius of curvature r of the curved face 42 and the radius of curvature R of the rotor 40 are approximately identical (L1, almost no cut-away is formed), resistance in the passage 43 is greater when the paper is to be printed (the passage being located where the angle is 0°). It is consequently difficult to supply a specified quantity of ink smoothly to the ink jet head 2 while the paper is being printed. In curve L4, this being the case where the passage 43A is formed by means of the plane cut-away portion 42A, (that is, r=infinity), there is too great a change of resistance in the passage, relative to the angle of rotation of the rotor 40A, when purging occurs. Consequently, there is the risk that the rotor 40A will rotate unevenly, that the motor will become out of step when the load on the driving motor changes greatly, and that the rotor 40A will stop rotating.

In the case where 1.1<r/R<1.3 (the range between the curves L2 and L3), there is less resistance in the passage 43 when the paper is to be printed. Consequently, it is easy to supply ink smoothly to the ink jet head 2 during printing. Further, there is a small change of resistance in the passage 43, relative to the change in angle of rotation of the rotor 40, during purging. The change in the load on the driving motor can be suppressed, and the motor does not readily become out of step. As a result, 1.1<r/R<1.3 is preferred.

If, for example, the ink supply destination is a 4 inch size ink jet head 2 at 600 dpi, ink viscosity is 3 cps, the diameter of the housing member 31 is 20 mm, the height of the rotor is 12 mm, R=8.7 mm, and r=10.6 mm, resistance in the passage is suppressed to 1.0 kPa/(ml/s), and there is no under-refilling (shortage of ink within the inkjet head that will be generated when the ink jet head injects greater amount of ink than the ink amount that is drawn into the ink jet head due to reduced pressure caused by the ink discharge), and no obstruction to the supply of ink during printing, etc. Furthermore, compression of 4.7 ml/s (the rotor 40 rotating at 14.6 rps) can be achieved during purging with a normal stepping motor of 40 square millimeter, and thus a current velocity can be obtained that allows efficient purging. Moreover, resistance required in the passage differs according to the size of the ink jet head 2 (the ink supply destination), frequency of ink discharge, or droplet quantity.

FIG. 8(*b*) shows the relationship between the angle of rotation of the rotor and resistance in the passage for the case where the curved face 42 is formed across a range of 40° of the outer periphery of the rotor 40. Even in the case where the resistance in the passage is required to be even smaller, if the angle forming the curved wall 42 is made smaller and is chosen from within the range in which r/R is 1.1 to 1.3, the resistance in the passage can be reduced to the value required, pump efficiency can be increased, and a well-balanced pump performance can be realized.

The following results are obtained using the pump described above.

The cap-shaped cover member 60 provided with the sealing portion 61 and the side portion 62 is fixed to the housing member 31 by means of the three screws 70 that are disposed equidistantly along the circumference direction. As a result, force is applied uniformly to the sealing portion 61 and this consequently fits tightly with the upper part of the housing member 31 along its entire circumference. Furthermore, when the cover member 60 is not fixed to the housing member 31, the connecting portion 63 is above the fixing part 31*e* and is separated therefrom by the minute space "d". When the cover member 60 is to be fixed to the housing member 31 by means of the three screws 70, the sealing portion 61 is pulled towards the upper part of the housing member 31, thus fixing the cover member 60 more reliably therewith. As a result, ink within the cavity 32 is reliably prevented from leaking to the exterior. Especially, the inner face of the upper end of the cylindrical wall 31*h* of the housing member 31 is pushed into the fitting face 61*c* at the inner side of the concave groove 61*b* of the cover member 60, and thus the inner face 31*g* follows the shape of the fitting face 61*c*. The shape of the cavity 32 within the housing member 31 is thus adjusted reliably into the predetermined shape. Therefore, ink can also reliably be prevented from leaking between the divided spaces 100*a*, 101, and 100*b* which are separated by the separating member 50 and the rotor 40. The efficiency of the pump 30 is thus increased.

The radius of curvature r of the curved face 42, this forming the passage 43 linking the inlet port 31*a* and the outlet port 31*b*, is greater than the radius of curvature R of the rotor 40. Consequently, during purging, there is a smaller rate of change in the resistance in the passage relative to the change in the angle of rotation of the rotor 40. As a result, there is a smaller change in the load on the rotor 40, and the rotor 40 can thus rotate smoothly. That is, the driving motor driving the rotation of the rotor 40 does not readily become out of step, and the rotor 40 can thus rotate at high speed. Further, while printing is being performed, there is little resistance in the passage 43 when the pump 30 is in a halted state, and ink can be supplied smoothly to the ink jet head 2.

Next, variations on the above embodiment will be described. Components configured identically to those of the above embodiment have the same reference numbers assigned thereto and a description thereof is omitted.

(1) The means for fixing the side portion 62 to the housing member 31 is not limited to the screws 70 of the above embodiment. For example, a cover member may be fixed to a housing member by fitting a connecting portion of the cover member with a fixing portion of the housing member. Alternatively, the side portion may be fixed irremovably to the housing member by bonding, welding, etc.

(2) The side portion of the cover member 60 needs not be cylindrical as in the above embodiment. For example, a plurality of side portions that are separated in a circumference direction may extend towards the fixing part 31*e* of the housing member 31. Furthermore, the side faces of the housing member may be covered entirely by the side portion. Moreover, a connecting portion of the cover member and a fixing portion of the housing member need not extend horizontally in a collar shape. Other shapes can be adopted as long as these shapes allow the cover member to fit with the fixing portion of the housing member.

(3) A curved face of the rotor may also extend along the entire length of the rotor in the axial direction thereof. In this case, forming the curved face in the rotor is easier.

(4) It is preferred that a curved face of the rotor is formed at a limited portion in an axial direction of the rotor. Specifically, it is preferred that the curved face of the rotor is formed along a limited distance in the middle of the rotor in the axial direction of the rotor. It is preferred that the rotor has complete circular cross sections at the upper and lower ends. The complete circular cross sections provide constant guide of the rotation of the rotor by the housing. This merit may be obtained even the cut-away is plane or flat.

The invention claimed is:

1. A pump comprising:

a first housing member including a cylindrical wall, a bottom wall provided at one end of the cylindrical wall, a fixing portion provided at an outer side of the cylindrical wall, the other end of the cylindrical wall being open, and an inlet port and an outlet port being formed in the cylindrical wall;

a rotor installed within the first housing member;

a separating member to be rotated with the rotor, an edge of the separating member being in contact with an inner face of the first housing member, wherein an inner cavity of the first housing member is separated into a plurality of divided spaces by the separating member and the rotor, and wherein the edge of the separating member slides along the inner face of the first housing member while the separating member is rotated with the rotor; and a second housing member including a sealing portion, a side portion and a connecting portion, wherein the sealing portion makes tight contact with the open end of the cylindrical wall of the first housing member, the side portion extends from the sealing portion to the fixing portion of the first housing member along an outer face of the cylindrical wall of the first housing member, the connecting portion is provided at a distal end of the side portion, and the connecting portion is connected to the first housing member, wherein a supporting groove for supporting the separating member extends within the rotor both in a radial direction of the rotor and in an axial direction of the rotor, and the supporting groove extends from the rotor into a rotary shaft connected with the rotor, and wherein the separating member protrudes from the rotor both in the radial direction of the rotor and in the axial direction of the rotor.

2. A pump of claim 1, wherein when the second housing member is not in a connected state with the first housing member, the connecting portion of the second housing member is separated by a certain distance from the first housing member.

3. A pump of claim 2, wherein the connecting portion of the second housing member is pulled towards the first housing member by means of a screw extending in the direction of a rotary shaft of the rotor, and is fixed to the first housing member.

4. A pump of claim 1, wherein a concave groove is formed in the sealing portion of the second housing member, a fitting face is formed at an inner face of the concave groove, the open end of the cylindrical wall of the first housing member being received within this concave groove, and an inner face of the cylindrical wall of the first housing member fits tightly with the fitting face.

5. A pump of claim 1, wherein a ring-shaped sealing member is fitted between an inner face of the side portion of the second housing member and the outer face of the cylindrical wall of the first housing member.

6. A pump of claim 1, wherein a rotary shaft of the rotor extending from the rotor towards the second housing member is formed in an integral manner with the rotor, and a concave shaft receiving portion capable of receiving the rotary shaft is formed in the sealing portion of the second housing member.

7. A pump of claim 1, wherein a rotary shaft of the rotor extending from the rotor towards the bottom side of the first housing member is formed in an integral manner with the rotor, and a shaft receiving hole capable of supporting the rotary shaft is formed in the bottom side of the first housing member.

8. A pump of claim 1, wherein the inlet port is linked with an ink cartridge, and the outlet port is linked with an ink jet head.

9. An ink jet printer, wherein an inlet port of the pump of claim 1 is linked with an ink cartridge, and an outlet port of the pump of claim 1 is linked with an ink jet head.

10. A pump comprising:

a first housing member including a cylindrical wall, a bottom wall provided at one end of the cylindrical wall, a fixing portion provided at an outer side of the cylindrical wall, the other end of the cylindrical wall being open, and an inlet port and an outlet port being formed in the cylindrical wall;

a rotor installed within the first housing member, a separating member to be rotated with the rotor, an edge of the separating member being in contact with an inner face of the first housing member, wherein an inner cavity of the first housing member is separated into a plurality of divided spaces by the separating member and the rotor, and wherein the edge of the separating member slides along the inner face of the first housing member while the separating member is rotated with the rotor; and a second housing member including a sealing portion, a side portion and a connecting portion, wherein the sealing portion makes tight contact with the open end of the cylindrical wall of the first housing member, the side portion extends from the sealing portion to the fixing portion of the first housing member along an outer face of the cylindrical wall of the first housing member, the connecting portion is provided at a distal end of the side portion, and the connecting portion is connected to the first housing member, wherein a concave groove is formed in the sealing portion of the second housing member, a fitting face is formed at an inner face of the concave groove, the open end of the cylindrical wall of the first housing member being received within this concave groove, and an inner face of the cylindrical wall of the first housing member fits tightly with the fitting face.

* * * * *